US006871852B2

(12) United States Patent
Bruhn

(10) Patent No.: US 6,871,852 B2
(45) Date of Patent: Mar. 29, 2005

(54) VACUUM PLATEN ASSEMBLY FOR FLUID-EJECTION DEVICE WITH ONE OR MORE AEROSOL-COLLECTION RECESSES

(75) Inventor: Victor Bruhn, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 155 days.

(21) Appl. No.: 10/295,971

(22) Filed: Nov. 15, 2002

(65) Prior Publication Data

US 2004/0125170 A1 Jul. 1, 2004

(51) Int. Cl.[7] ..... B65H 5/02
(52) U.S. Cl. ..... 271/276; 347/90; 101/231
(58) Field of Search ..... 271/276; 347/90, 347/104; 101/225, 228, 231, 232, 233

(56) References Cited

U.S. PATENT DOCUMENTS

| | | | | | |
|---|---|---|---|---|---|
| 6,571,702 | B2 | * | 6/2003 | Wotton et al. | 101/232 |
| 2001/0028380 | A1 | * | 10/2001 | Wotten et al. | 347/102 |
| 2003/0080501 | A1 | * | 5/2003 | Perez et al. | 271/276 |

FOREIGN PATENT DOCUMENTS

| | | | | |
|---|---|---|---|---|
| GB | 2 359 277 | | 8/2001 | |
| GB | 2359277 | * | 8/2001 | B41J/29/17 |

* cited by examiner

*Primary Examiner*—Harry B. Tanner

(57) ABSTRACT

A vacuum platen assembly for a fluid-ejection device of one embodiment of the invention is disclosed that includes a platen that has a number of vacuum holes, and one or more aerosol-collection recesses. A number of ribs extend from the platen, against which position of media is maintained by suction effect from the vacuum holes.

37 Claims, 3 Drawing Sheets

VACUUM PLATEN ASSEMBLY FOR FLUID-EJECTION DEVICE WITH ONE OR MORE AEROSOL-COLLECTION RECESSES

BACKGROUND OF THE INVENTION

Inkjet printers have become popular for printing on media, especially when precise printing of color images is needed. For instance, such printers have become popular for printing color image files generated using digital cameras, for printing color copies of business presentations, and so on. An inkjet printer is more generically a fluid-ejection device that ejects fluid, such as ink, onto media, such as paper.

To maintain positioning of the media while fluid is being ejected onto the media, some fluid-ejection devices utilize a vacuum effect to keep the media properly in place. For example, a number of vacuum holes within a vacuum platen, fluidly coupled with a vacuum source such as a centrifugal blower, can provide this effect. However, vacuum-induced flow may also pull aerosol towards them. Aerosol includes fluid particles generated when the fluid is ejected. The aerosol may collect on the vacuum platen as it is being pulled by vacuum-induced flow towards the vacuum holes, contaminating the media when it makes contact with the platen.

SUMMARY OF THE INVENTION

A vacuum platen assembly for a fluid-ejection device of one embodiment of the invention includes a platen that has a number of vacuum holes, and one or more aerosol-collection recesses. A number of ribs extend from the platen, against which position of media is maintained by suction effect from the vacuum holes.

BRIEF DESCRIPTION OF THE DRAWINGS

The drawings referenced herein form a part of the specification. Features shown in the drawing are meant as illustrative of only some embodiments of the invention, and not of all embodiments of the invention, unless otherwise explicitly indicated, and implications to the contrary are otherwise not to be made.

DETAILED DESCRIPTION OF THE DRAWINGS

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Figure 1:
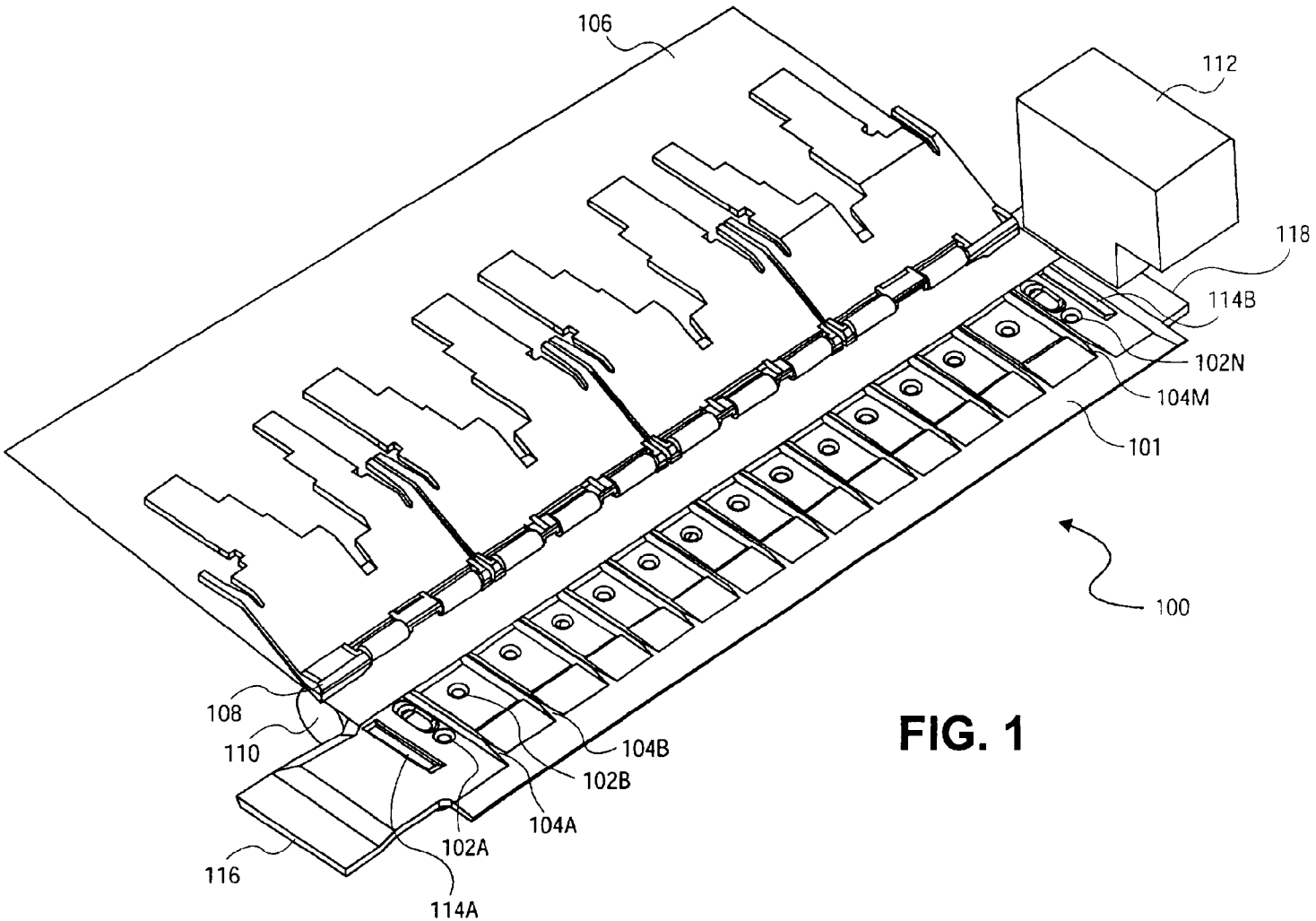
FIG. 1 is a diagram of a representative vacuum platen assembly of a fluid-ejection device, according to an embodiment of the invention.

FIG. 1 shows a representative vacuum platen assembly 100 for a fluid-ejection device, according to an embodiment of the invention. As can be appreciated by those of ordinary skill within the art, other types of vacuum platen assemblies, besides the assembly 100 of FIG. 1, may be utilized in conjunction with embodiments of the invention. The fluid-ejection device may be, for instance, a black-and-white and/or color inkjet printer for outputting ink onto media, such as paper. More generally, the fluid-ejection device outputs fluid onto media.

The vacuum platen assembly 100 includes a vacuum platen 101. As shown in FIG. 1, the vacuum platen 101 is positioned against a drive roller 110, over which a pinch roller 108 is positioned. Media 106 is fed through the drive roller 110 and the pinch roller 108 by forced rotation of the drive roller 110. As the media 106 then moves over the vacuum platen 101, a fluid-ejecting mechanism 112, such as a fluid-ejecting head like an inkjet printhead, moves back and forth over the media 106, ejecting fluid onto the media 106, which may be paper.

The vacuum platen assembly 100 includes a number of ribs 104A, 104B, . . . , 104M, collectively referred to as the ribs 104, that extend from the vacuum platen 101. The vacuum platen assembly 100 also includes a number of vacuum holes 102A, 102B, . . . , 102N, collective referred to as the vacuum holes 102. There may be more or less of the vacuum holes 102 as compared to the ribs 104. The vacuum holes 102 can extend completely through the vacuum platen 101 and provide a fluid connection with an external vacuum source, such as a centrifugal blower. The vacuum holes 102 may alternatively extend partially through the vacuum platen 101.

As the media 106 is fed between the pinch roller 108 and the drive roller 110, it passes over the vacuum platen 101. To maintain positioning of the media 106 against the ribs 104, suction effect provided by the external vacuum source, transmitted via vacuum holes 102, suctions the media 106 against the ribs 104. The fluid-ejecting mechanism 112 then moves back and forth over the media 106 to eject fluid onto the media 106. Preferably, one of the ribs 104 is situated between every successively rolling pair of the holes 102. For example, the rib 104A is situated between the holes 102A and 102B. Ejection of the fluid by the fluid-ejecting mechanism 112 can result in fluid aerosol, which includes very small airborne particles of fluid. Although some of the aerosol may be suctioned through the holes 102, other of the aerosol may not.

Therefore, the vacuum platen assembly 100 includes a pair of aerosol-collection recesses 114A and 114B, referred to collectively as the aerosol-collection recesses 114, to collect such aerosol. The recess 114A is situated between an end 116 of the platen 101, and the vacuum hole 102A and the rib 104A. The recess 114B is similarly situated between an end 118 of the platen 101, and the vacuum hole 102N and the rib 104M. There may be more or less of the aerosol-collection recesses 114 than the two recesses 114A and 114B depicted in FIG. 1, and their locations may differ from those of the recesses 114 of FIG. 1.

For example, for media that is substantially smaller in width than the width of the platen assembly 100, the aerosol-collection recesses 114 as depicted in FIG. 1 may not have the desired effect of collecting aerosol, since the recesses 114 are located towards the ends 116 and 118 of the platen 101. Therefore, there may be recesses, in addition to or in lieu of the recesses 114, on the platen 101. For instance, there may be recesses interspersed among the holes 102 and the ribs 104 of the platen 101 in one embodiment of the invention, such as recesses located more towards the center of the platen 101. In the case where the width of the platen assembly 100 is sufficiently great to accommodate 8½" by 11" letter-sized media, the presence of these additional recesses may aid in the collection of aerosol when smaller-sized media, such as B5 media, and so on, is utilized.

Figure 2:
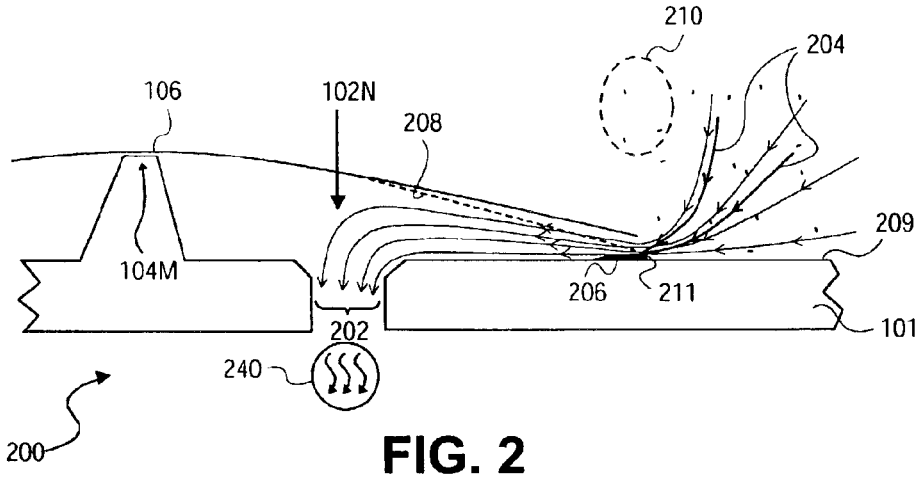
FIG. 2 is a diagram of a side profile of the vacuum platen assembly of FIG. 1 in more detail that shows the undesirable aerosol collection substantially prevented by embodiments of the invention.

The manner by which the recesses 114 collect aerosol that is not suctioned through the holes 102 is now described, first by describing what occurs if the recesses 114 are not present, and then by describing what occurs when the recesses 114 are present. FIG. 2 shows a scenario 200 that depicts the collection of aerosol on the top surface of the vacuum platen, potentially causing aerosol contamination of the media, which is at least substantially prevented by embodiments of the invention. A side profile of a portion of the vacuum platen 101 is shown in detail, including the rib 104M extended therefrom, and the vacuum hole 102N. The media 106 is positioned against the rib 104M, and moves outwards from the plane of FIG. 2.

Fluid aerosol is depicted in FIG. 2 by solid dots, such as the dots included within the dotted area 210. The fluid aerosol may become suctioned towards the vacuum hole 102N. The vacuum, or suction, effect results from a vacuum source, represented by the blower symbol 240, such as a centrifugal blower. The path that the vacuum-induced air flow follows in its movement towards the hole 102N is represented by the arrows 202. Conversely, the arrows 204 represent the motion of those aerosol particles which cannot fully make the turn under the media 106 and thus cannot be suctioned through the vacuum hole 102N. Rather, such aerosol collides with and collects on top surface 209 of the vacuum platen 101, resulting in the collection of fluid aerosol 206. Should the media 106 drop down to the position indicated by the reference number 208, the end of the media 211 contacts the collection of aerosol 206, causing the backside of the media 106 to become contaminated with fluid. This is particularly problematic where both sides of the media 106 are intended to be used for fluid output, such as inkjet printing, thereon.

Figure 3:
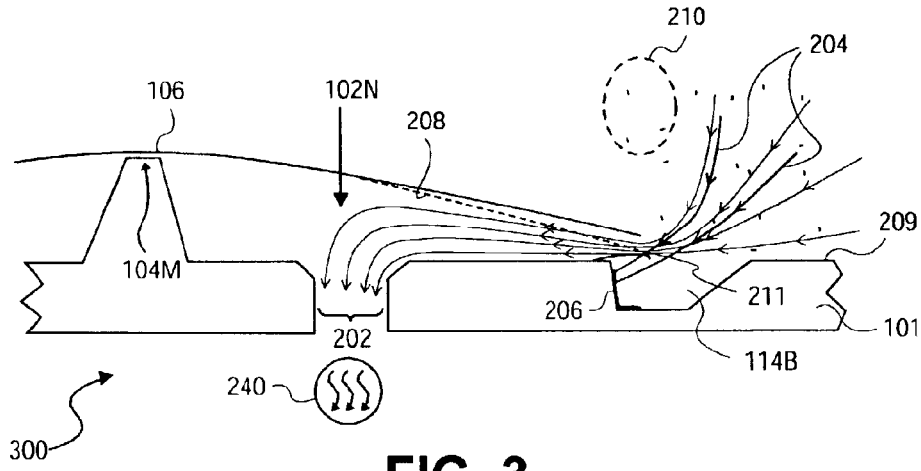
FIG. 3 is a diagram of a side profile of the vacuum platen assembly of FIG. 1 in more detail that shows how an aerosol-collection recess substantially prevents aerosol contamination of the media, according to an embodiment of the invention.

FIG. 3 shows a scenario 300 that depicts the at least substantial prevention of such aerosol contamination of media, according to an embodiment of the invention. A side profile of a portion of the vacuum platen 101 is shown in detail, including the rib 104M extended therefrom, and the vacuum hole 102N. Also present is the aerosol-collection recess 114B. The media 106 is positioned against the rib 104M, and moves outward from the plane of FIG. 3. Fluid aerosol is again depicted in FIG. 3 by solid dots, such as the dots included within the dotted area 210. The fluid aerosol may be pulled by vacuum-induced flow towards the vacuum hole 102N, by the vacuum source, represented by the blower symbol 240, in the direction of the arrows 202 or 204. The arrows 202 represent the motion of the vacuum-induced air flow.

However, unlike the scenario 200 of FIG. 2, in the scenario 300 of FIG. 3, the arrows 204 that represent the motion of aerosol particles which cannot make the turn under the media 106 now collide with and collect within the aerosol-collection recess 114B, instead of colliding with and collecting on the top surface 209 of the platen 101. The aerosol-collection recess 114B thus at least substantially collects the aerosol that results from fluid ejected towards the media 106 that is unable to be suctioned through the vacuum hole 102N. In so doing, the recess 114B at least substantially prevents contamination of the media 106 by the aerosol. This is because if and/or when the media 106 drops down to the position indicated by the reference number 108, the end of the media 211 does not contact the collection of aerosol 206. Therefore, but for the recess 114B, such aerosol would likely otherwise collect on the top surface 209 of the platen 101, contaminating the media 106 as the media 106 moves over the platen 101 and makes contact with the platen 101.

The operation and functionality of the aerosol-collection recess 114A of FIG. 1 is identical to that of the recess 114B that has been described in conjunction with the embodiment of FIG. 3, except that the aerosol-collection recess 114A is situated towards the other end of the vacuum platen 101. The aerosol-collection recess 114B has been depicted in FIG. 3 as having a particular side profile, and the aerosol-collection recesses 114 more generally have been depicted in FIG. 1 as having a particular shape. The side profile and shape that are shown are for example purposes only, however, and do not represent a limitation on all embodiments of the invention. That is, aerosol-collection recesses according to other embodiments of the invention may have different shapes and side profiles than those depicted in FIGS. 1 and 3.

Figure 4:
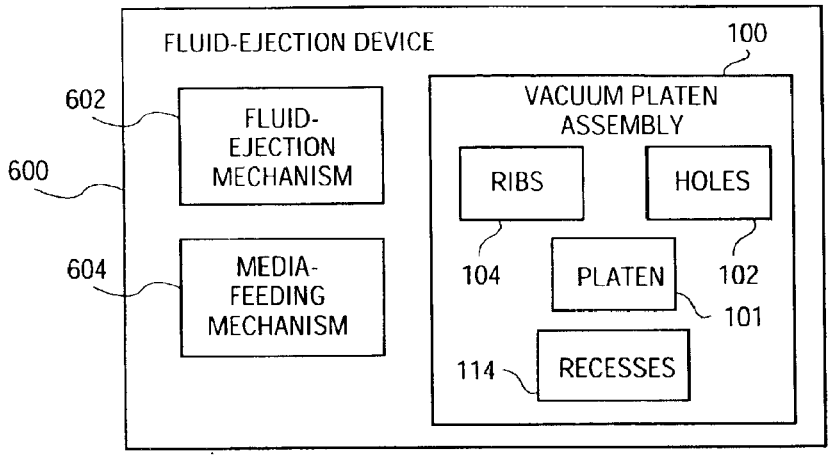
FIG. 4 is a block diagram of a fluid-ejection device, according to an embodiment of the invention.

FIG. 4 shows a block diagram of a representative fluid-ejection device 600, according to an embodiment of the invention. The fluid-ejection device 600 may be an inkjet printer, or another type of fluid ejection device. The fluid-ejection device 600 includes a fluid-ejection mechanism 602, a media-feeding mechanism 604, and the vacuum platen assembly 100, a particular embodiment of which is depicted in FIG. 1.

The fluid-ejection mechanism 602 ejects fluid onto media, such as ink onto media like paper. The mechanism 602 may be an inkjet-printing mechanism. The mechanism 602 may include a fluid-ejecting head, such as a fluid-ejecting head like an inkjet printhead. The media-feeding mechanism 604 feeds media for ejection of fluid thereon by the fluid-ejecting mechanism 602. In one embodiment, the mechanism 604 includes the rollers 108 and/or 110 of FIG. 1.

The vacuum platen assembly 100 is specifically depicted in FIG. 4 as including aerosol-collection recesses 114, ribs 104, vacuum holes 102, and the platen 101. The aerosol-collection recesses 114 may each be that as has been shown in and described in conjunction with FIG. 3. That is, the recesses 114 at least substantially collect aerosol that otherwise is not suctioned through the holes 102, to at least substantially prevent aerosol contamination of the media. As has also been described, the ribs 104 extend from the platen 101, and the vacuum holes 102 transmit vacuum from an external vacuum source to maintain positioning of the media against the ribs 104.

Figure 5:
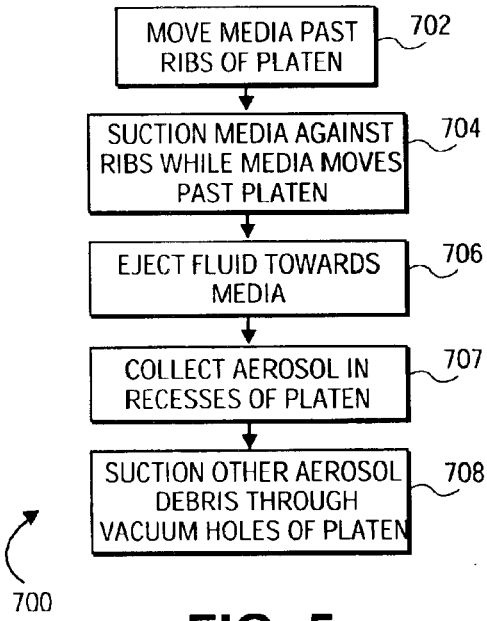
FIG. 5 is a flowchart of a method, according to an embodiment of the invention.

FIG. 5 shows a method 700, according to an embodiment of the invention. The method 700 can be utilized in conjunction with the vacuum platen assembly 100 of FIG. 1, the aerosol-collection recesses 114 of FIGS. 1 and 3, and/or the fluid-ejection device 600 of FIG. 4. First, media is moved past ribs that extend from a vacuum platen (702). As the media moves past the platen, the media is suctioned against the ribs (704), due to the effect of an external vacuum source transmitted by the vacuum holes within the platen. Fluid is then ejected towards the media (706), which can result in aerosol. At least some of the aerosol collects in one or more aerosol-collection recesses of the platen (707). This aerosol may otherwise contaminate the media if it were not collected in the recesses. Other of the aerosol is suctioned through the vacuum holes of the platen (708).

Figure 6:
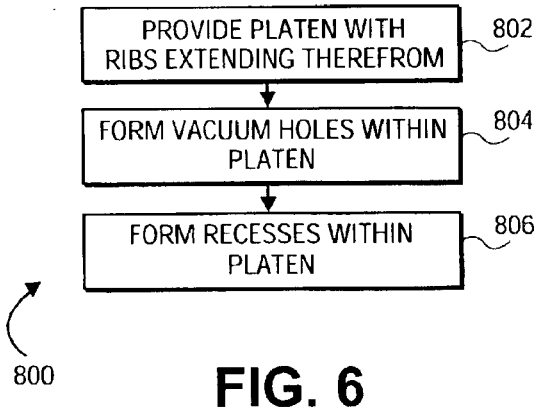
FIG. 6 is a flowchart of a method for manufacturing a vacuum platen assembly, according to an embodiment of the invention.

FIG. 6 shows a method 800 for manufacturing a vacuum platen assembly, according to an embodiment of the invention. The method 800 can be utilized to manufacture the vacuum platen assembly 100 of FIG. 1 having the aerosol-collection recesses 114 that one of which is particularly depicted in FIG. 3. A platen, such as a vacuum platen, is provided that has ribs extending therefrom (802). Vacuum holes are then formed within the platen (804). The vacuum holes may be formed completely or at least partially through the platen. Finally, one or more aerosol-collection recesses are formed within the platen (806). It is noted that the platen with the ribs, vacuum holes, and aerosol-collection recesses may be provided at the same time, such as via a single injection-molding operation.

It is noted that, although specific embodiments have been illustrated and described herein, it will be appreciated by those of ordinary skill in the art that any arrangement is calculated to achieve the same purpose may be substituted for the specific embodiments shown. This application is intended to cover any adaptations or variations of the present invention. Therefore, it is manifestly intended that this invention be limited only by the claims and equivalents thereof.

What is claimed is:

1. A vacuum platen assembly for a fluid-ejection device comprising:

a platen having a plurality of vacuum holes and one or more aerosol-collection recesses; and, a plurality of ribs extending from the platen, against which positioning of media is maintained by suction effect from the plurality of vacuum holes, wherein at least one of the plurality of ribs each extends from the platen between a pair of adjacent vacuum holes of the plurality of vacuum holes.

2. The vacuum platen assembly of claim 1, further comprising a vacuum source providing the suction effect of the plurality of vacuum holes.

3. The vacuum platen assembly of claim 1, wherein the one or more aerosol-collection recesses at least substantially collect aerosol resulting from fluid ejected towards the media that is unable to be suctioned through the plurality of vacuum holes.

4. The vacuum platen assembly of claim 3, wherein collection of the aerosol by the one or more aerosol-collection recesses at least substantially prevents contamination of the media by the aerosol.

5. The vacuum platen assembly of claim 3, wherein the aerosol resulting from the fluid ejected towards the media that is unable to be suctioned through the plurality of vacuum holes otherwise would collect on another surface of the platen.

6. The vacuum platen assembly of claim 5, wherein the aerosol that would otherwise collect on the other surface of the platen would contaminate the media as the media moves over the platen.

7. The vacuum platen assembly of claim 3, wherein additional aerosol results from the fluid ejected towards the media that is able to be suctioned through the plurality of vacuum holes.

8. The vacuum platen assembly of claim 1, wherein the plurality of vacuum holes are situated within the platen.

9. The vacuum platen assembly of claim 1, wherein the plurality of vacuum holes are situated through the platen.

10. The vacuum platen assembly of claim 1, wherein the fluid-ejection device is an inkjet printer.

11. A vacuum platen assembly for a fluid-election device comprising:

a platen having a plurality of vacuum holes and one or more aerosol-collection recesses; and, a plurality of ribs extending from the platen, against which positioning of media is maintained by suction effect from the plurality of vacuum holes, wherein the plurality of vacuum holes includes a first vacuum hole and a last vacuum hole, and the one or more aerosol-collection recesses include a first aerosol-collection recess and a second aerosol-collection recess, the first aerosol-collection recess situated on the platen between a first end thereof and the first vacuum hole, the second aerosol-collection recess situated on the platen between a second end thereof and the last vacuum hole.

12. A vacuum platen assembly for a fluid-ejection device comprising:

a platen having a plurality of vacuum holes and one or more aerosol-collection recesses; and, a plurality of ribs extending from the platen against which positioning of media is maintained by suction effect from the plurality of vacuum holes, wherein the plurality of ribs includes a first rib and a last rib, and the one or more aerosol-collection recesses include a first aerosol-collection recess and a second aerosol-collection recess, the first aerosol-collection recess situated on the platen between a first end thereof and the first rib, the second aerosol-collection recess situated on the platen between a second end thereof and the last rib.

13. A vacuum platen assembly for a fluid-ejection device comprising:

a platen having a plurality of vacuum holes and one or more aerosol-collection recesses; and, a plurality of ribs extending from the platen, against which positioning of media is maintained by suction effect from the plurality of vacuum holes, wherein the plurality of ribs extend from the platen between every successively rolling vacuum hole pair of the plurality of vacuum holes.

14. A vacuum platen assembly for a fluid-ejection device comprising:

a platen having a plurality of vacuum holes and one or more recesses that at least substantially preventing aerosol contamination of media moving over the platen; and, a plurality of ribs extending from the platen, against which positioning of the media is maintained by suction effect from the plurality of vacuum holes, wherein at least one of the plurality of ribs each extends from the platen between a pair of adjacent vacuum holes of the plurality of vacuum holes.

15. The vacuum platen assembly of claim 14, wherein the one or more recesses at least substantially collect aerosol resulting from fluid ejected towards the media that is unable to be suctioned through the plurality of vacuum holes and that would otherwise collect on another surface of the platen.

16. The vacuum platen assembly of claim 14, wherein the fluid-ejection device is an inkjet printer.

17. A vacuum platen assembly for a fluid-ejection device comprising:

a platen having a plurality of vacuum holes;

a plurality of ribs extending from the platen, against which positioning of media is maintained by suction effect from the plurality of vacuum holes; and, means for at least substantially preventing aerosol contamination of the media, wherein at least one of the plurality of ribs each extends from the platen between a pair of adjacent vacuum holes of the plurality of vacuum holes.

18. The vacuum platen assembly of claim 17, wherein the means comprises one or more recesses within the platen.

19. The vacuum platen assembly of claim 17, wherein the fluid-ejection device is an inkjet printer.

20. A fluid-ejection device comprising:

a fluid-ejection mechanism ejecting fluid towards media, ejection of the fluid resulting in dispersal of aerosol;

a vacuum platen having a plurality of vacuum holes and one or more aerosol collection-recesses; and, a plurality of ribs extending from the vacuum platen, against which positioning of the media is maintained by suction effect from the plurality of vacuum holes, wherein at least one of the plurality of ribs each extends from the vacuum platen between a pair of adjacent vacuum holes of the plurality of vacuum holes.

21. The fluid-ejection device of claim 20, wherein the one or more aerosol-collection recesses at least substantially collect the aerosol that is unable to be suctioned through the plurality of vacuum holes, other of the aerosol able to be suctioned through the plurality of vacuum holes.

22. The fluid-ejection device of claim 21, wherein collection of the aerosol by the one or more aerosol-collection recesses at least substantially prevents contamination of the media by the aerosol.

23. The fluid-ejection device of claim 20, wherein the plurality of ribs extend from the vacuum platen between every successively rolling vacuum hole pair of the plurality of vacuum holes.

24. A fluid-ejection device comprising:

a fluid-ejection mechanism ejecting fluid towards media, ejection of the fluid resulting in dispersal of aerosol;

a vacuum platen having a plurality of vacuum holes and one or more aerosol collection-recesses; and, a plurality of ribs extending from the vacuum platen against which positioning of the media is maintained by suction effect from the plurality of vacuum holes, wherein the plurality of vacuum holes includes a first vacuum hole and a last vacuum hole, and the one or more aerosol-collection recesses include a first aerosol-collection recess and a second aerosol-collection recess, the first aerosol-collection recess situated on the vacuum platen between a first end thereof and the first vacuum hole, the second aerosol-collection recess situated on the vacuum platen between a second end thereof and the last vacuum hole.

25. A fluid-ejection device comprising:

a fluid-ejection mechanism ejecting fluid towards media, ejection of the fluid resulting in dispersal of aerosol;

a vacuum platen having a plurality of vacuum holes and one or more aerosol collection-recesses; and, a plurality of ribs extending from the vacuum platen, against which positioning of the media is maintained by suction effect from the plurality of vacuum holes, wherein the plurality of ribs includes a first rib and a last rib, and the one or more aerosol-collection recesses include a first aerosol-collection recess and a second aerosol-collection recess, the first aerosol-collection recess situated on the vacuum platen between a first end thereof and the first rib, the second aerosol-collection recess situated on the vacuum platen between a second end thereof and the last rib.

26. A fluid-ejection device comprising:

a fluid-ejection mechanism ejecting fluid towards media, ejection of the fluid resulting in dispersal of aerosol;

a vacuum platen having a plurality of vacuum holes and one or more aerosol collection-recesses; and, a plurality of ribs extending from the vacuum platen, against which positioning of the media is maintained by suction effect from the plurality of vacuum holes, wherein the fluid-ejection device is an inkjet printer, the fluid-ejection mechanism is an inkjet-printing mechanism, the fluid is ink, and the aerosol is ink aerosol.

27. A method comprising:

suctioning media against a plurality of ribs of a platen utilizing a plurality of vacuum holes through the platen, at least one of the plurality of ribs each extending from the platen between a pair of adjacent vacuum holes of the plurality of vacuum holes;

ejecting fluid towards the media, resulting in dispersal of aerosol, the aerosol moving towards at least some of the plurality of vacuum holes because of the suctioning;

collecting at least some of the aerosol in one or more recesses of the platen that would otherwise contaminate the media.

28. The method of claim 27, further comprising suctioning other of the aerosol through the plurality of holes of the platen.

29. The method of claim 27, wherein the platen is part of a fluid-ejection device.

30. The method of claim 27, wherein the fluid is ink, and the aerosol is ink aerosol.

31. A method comprising:

providing a platen having a plurality of ribs extending therefrom;

forming a plurality of vacuum holes within the platen, such that at least one of the plurality of ribs each extends from the platen between a pair of adjacent vacuum holes of the plurality of vacuum holes; and, forming one or more aerosol-collection recesses within the platen.

32. The method of claim 31, wherein forming the plurality of vacuum holes within the platen comprises forming the plurality of vacuum holes through the platen.

33. The method of claim 31, wherein providing the platen comprises providing a vacuum platen of a fluid-ejection device.

34. The method of claim 31, wherein providing the platen comprises providing a vacuum platen of an inkjet printer.

35. A method comprising:

providing a platen having a plurality of ribs extending therefrom;

forming a plurality of vacuum holes within the platen; and, forming one or more aerosol-collection recesses within the platen, wherein forming the one or more aerosol-collection recesses within the platen comprises forming a first aerosol-collection recess within the platen between a first end thereof and a first of the plurality of vacuum holes and forming a second aerosol-collection recess within the platen between a second thereof and a last of the plurality of vacuum holes.

36. A method comprising:

providing a platen having a plurality of ribs extending therefrom;

forming a plurality of vacuum holes within the platen; and, forming one or more aerosol-collection recesses within the platen, wherein forming the one or more aerosol-collection recesses within the platen comprises forming a first aerosol-collection recess within the platen between a first end thereof and a first of the plurality of ribs and forming a second aerosol-collection recess within the platen between a second end thereof and a last of the plurality of ribs.

37. A method comprising:

providing a platen having a plurality of ribs extending therefrom;

forming a plurality of vacuum holes within the platen; and, forming one or more aerosol-collection recesses within the platen, wherein forming the plurality of vacuum holes within the platen comprises forming a vacuum hole between each successively rolling rib pair of the plurality of ribs, between a first rib of the plurality of ribs and a first end of the platen, and between a last rib of the plurality of ribs and a last end of the platen.

* * * * *

UNITED STATES PATENT AND TRADEMARK OFFICE

CERTIFICATE OF CORRECTION

PATENT NO. : 6,871,852 B2
APPLICATION NO. : 10/295971
DATED : March 29, 2005
INVENTOR(S) : Victor Bruhn It is certified that error appears in the above-identified patent and that said Letters Patent is hereby corrected as shown below:

Column 7, Claim 23, line 47, after “platen” insert --,--

Column 9, Claim 35, line 4, after “second” insert --end--

Signed and Sealed this

Thirteenth Day of March, 2007

JON W. DUDAS
*Director of the United States Patent and Trademark Office*